US010145379B1

(12) United States Patent
Martin, Jr. et al.

(10) Patent No.: US 10,145,379 B1
(45) Date of Patent: Dec. 4, 2018

(54) SOLAR POWERED VENTILATOR FAN

(71) Applicants: Donald Arthur Martin, Jr., Fontana, CA (US); Kathryn Louise Martin, Fontana, CA (US)

(72) Inventors: Donald Arthur Martin, Jr., Fontana, CA (US); Kathryn Louise Martin, Fontana, CA (US)

( * ) Notice: Subject to any disclaimer, the term of this patent is extended or adjusted under 35 U.S.C. 154(b) by 0 days.

(21) Appl. No.: 14/873,193

(22) Filed: Oct. 2, 2015

Related U.S. Application Data

(60) Provisional application No. 62/058,746, filed on Oct. 2, 2014.

(51) Int. Cl.

| | |
|---|---|
| ***A47K 11/04*** | (2006.01) |
| ***F04D 25/06*** | (2006.01) |
| ***E03D 9/04*** | (2006.01) |
| ***E04H 1/12*** | (2006.01) |

(52) U.S. Cl.
CPC ..... *F04D 25/06* (2013.01); *A47K 11/04* (2013.01); *E03D 9/04* (2013.01); *E04H 1/1216* (2013.01)

(58) Field of Classification Search
CPC ..... A47K 11/04; F04D 25/06
USPC ..... 4/477
See application file for complete search history.

(56) References Cited

U.S. PATENT DOCUMENTS

| | | | | |
|---|---|---|---|---|
| 261,398 | A * | 7/1882 | Smith | F23L 17/02 454/32 |
| 3,785,271 | A * | 1/1974 | Joy | F24F 13/078 219/220 |
| D254,567 | S | 3/1980 | Wagner | |
| 5,131,888 | A | 7/1992 | Adkins, II | |
| 5,394,663 | A * | 3/1995 | Jackson | E04D 13/17 285/43 |
| 6,306,030 | B1 * | 10/2001 | Wilson | F23L 17/10 454/16 |
| 6,699,119 | B2 * | 3/2004 | Boulanger | F24F 7/06 454/238 |
| 7,455,582 | B2 | 11/2008 | Barrett | |
| 2003/0116188 | A1 * | 6/2003 | Hsieh | F04D 25/06 136/244 |
| 2006/0277675 | A1 * | 12/2006 | Tinnell | E04H 1/1216 4/477 |
| 2010/0304660 | A1 * | 12/2010 | Boehling | F24F 7/025 454/343 |

* cited by examiner

*Primary Examiner* — Huyen Le
(74) *Attorney, Agent, or Firm* — RG Patent Consulting, LLC; Rachel Gilboy

(57) ABSTRACT

An exhaust fan assembly, powered by solar energy, that is specially designed for use with portable toilets as well as other small, enclosed spaces. Design intent is to provide a convenient, energy efficient means of keeping these units ventilated.

16 Claims, 6 Drawing Sheets

SOLAR POWERED VENTILATOR FAN

CROSS-REFERENCE TO RELATED APPLICATION

The present application is related to and claims priority from prior provisional application Ser. No. 62/058,746, filed Oct. 2, 2014 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

The present invention relates generally to the field of exhaust fans and more specifically relates to fans powered by solar energy specially designed for use with portable toilets and small, enclosed spaces.

2. Description of the Related Art

A portable toilet is a modern, portable, self-contained outhouse manufactured of molded plastic in a variety of colors and is often used as a temporary toilet at outdoor work sites, particularly construction sites, and large banks of dozens of portable toilets allow for ready sanitation at large gatherings such as outdoor music festivals. Portable toilets are large enough for a single occupant usually about three feet on a side by seven feet in height. While the units are typically free standing structures, their stability is augmented by the weight of the waste tank, which usually contains an empty liquid disinfectant dispenser and deodorizer. Some include both a seated toilet and a urinal, and most include lockable doors, ventilation near the top, and a stovepipe vent for the holding tank.

Yet, with all the modern accoutrements that are germane to these facilities, there are significant drawbacks to their use. Particularly, the units, as evidenced by the above dimensions, are typically tight quarters, even though they are ideally designed for one occupant. As can be imagined, on especially hot and muggy days, heat tends to build up quickly in the portable toilet. Turned into a veritable sweat box, these facilities become extremely uncomfortable to use. Additionally, the heat only exacerbates unpleasant odors left behind, leaving them to stew and build inside the unit without dissipating which is not desirable. An efficient exhausting means for odors is desirable.

Various attempts have been made to solve problems found in exhaust fan art. Among these are found in: U.S. Pat. No. 7,455,582 to Cory G. Barrett; U.S. Pat. No. 5,131,888 to Adkins II Dwight; and U.S. Pat. No. D254,567 to Clyde Wagner. This prior art is representative of exhaust fan.

None of the above inventions and patents, taken either singly or in combination, is seen to describe the invention as claimed. Thus, a need exists for a reliable exhaust fans to be powered by solar energy specially designed for use with portable toilets as well as other such small, enclosed spaces and to avoid the above-mentioned problems.

BRIEF SUMMARY OF THE INVENTION

In view of the foregoing disadvantages inherent in the known exhaust fans art, the present invention provides a novel exhaust fan assembly, powered by solar energy that is specially designed for use with portable toilets as well as other small, enclosed spaces. Design intent is to provide a convenient, energy efficient means of keeping these units sufficiently ventilated. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Solar Powered Ventilator Fan for Portable Toilets, constructed and operative according to the teachings of the present invention.

The various embodiments of the present invention will hereinafter be described in conjunction with the appended drawings.

DETAILED DESCRIPTION

As discussed above, embodiments of the present invention relate to an exhaust fan device and more particularly to a exhaust fan assembly, powered by solar energy as used to improve the ventilation in enclosed spaces.

Figure 1:
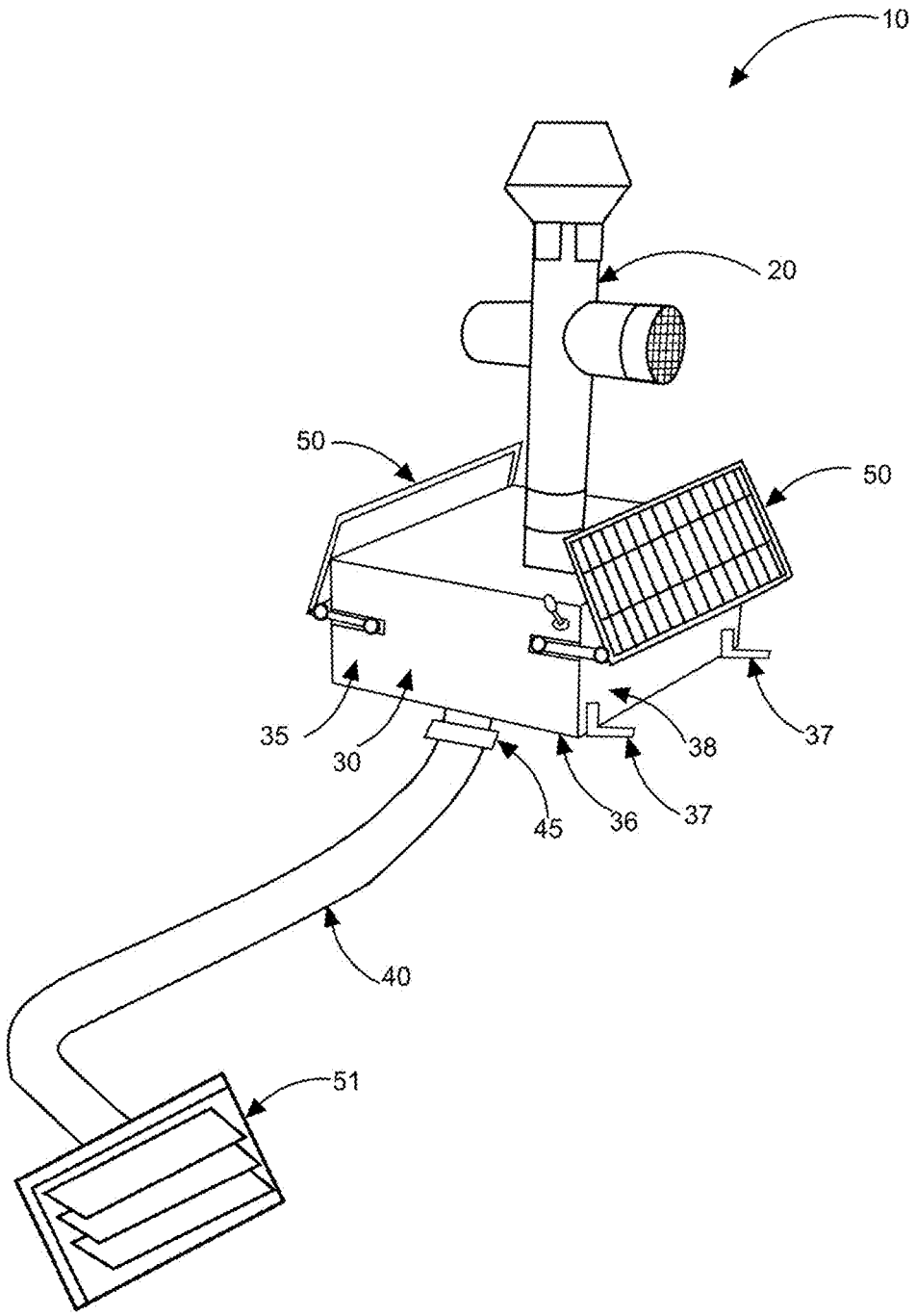
FIG. 1 shows a perspective view illustrating an exhaust fan assembly, powered by solar energy in use with vents open according to an embodiment of the present invention.
Figure 2:
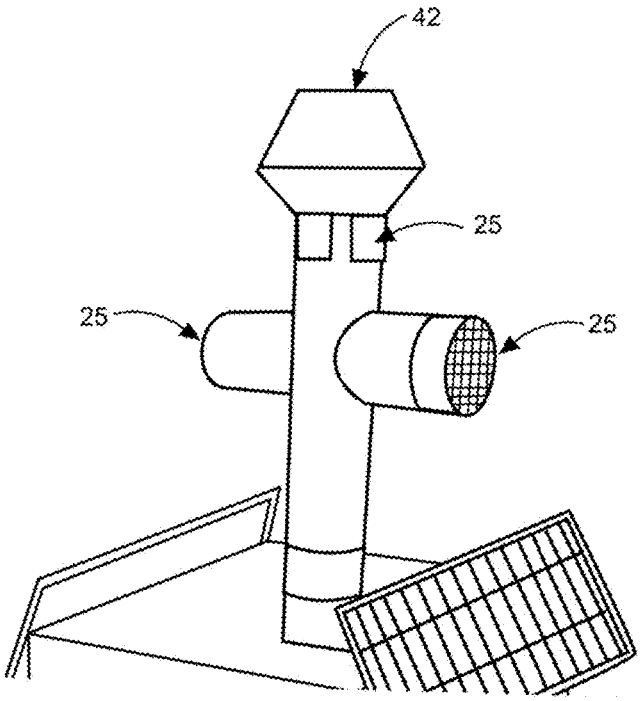
FIG. 2 is a perspective top view illustrating the exhaust fan assembly, powered by solar energy according to an embodiment of the present invention.
Figure 3:
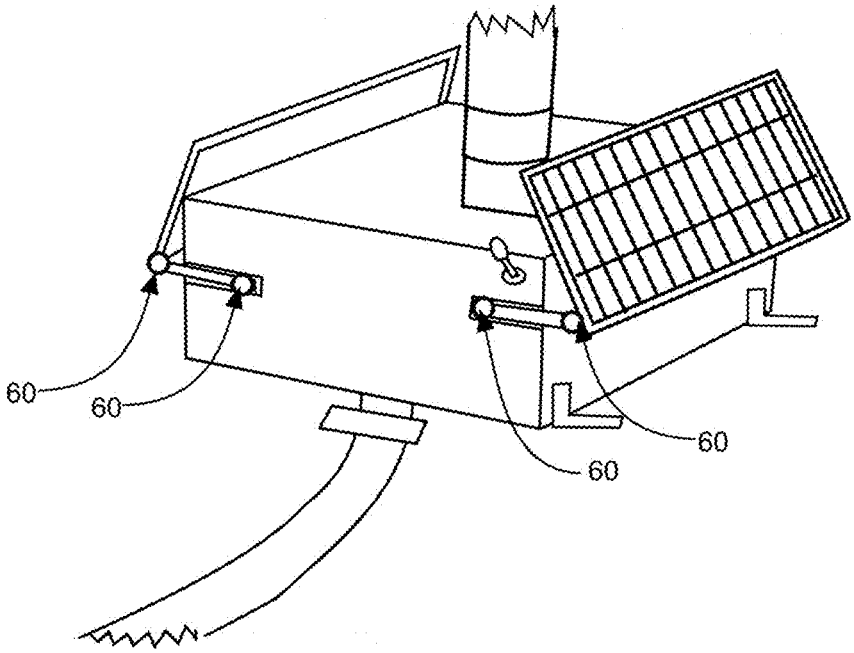
FIG. 3 is a perspective view illustrating the exhaust fan assembly solar panels according to an embodiment of the present invention.
Figure 4:
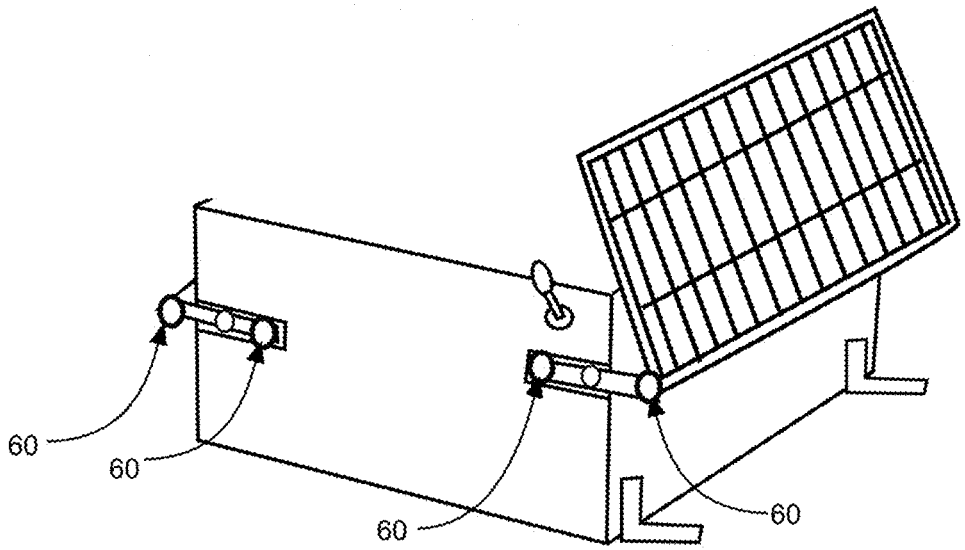
FIG. 4 is a perspective view illustrating the exhaust fan motor switch according to an embodiment of the present invention.
Figure 5:
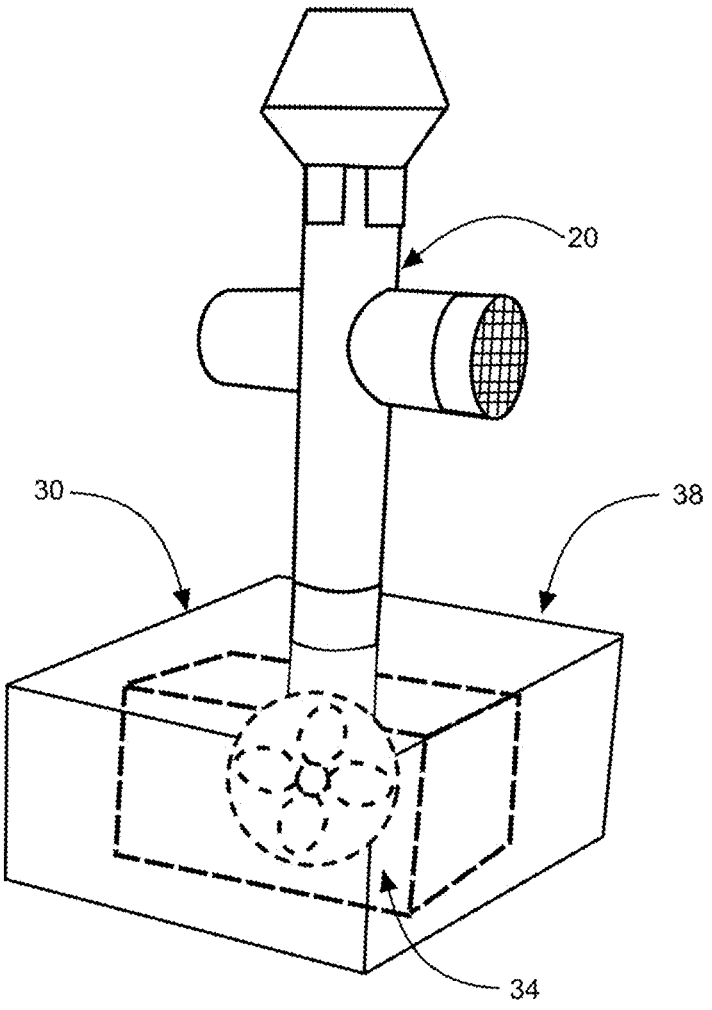
FIG. 5 is a perspective view illustrating the exhaust fan according to an embodiment of the present invention.
Figure 6:
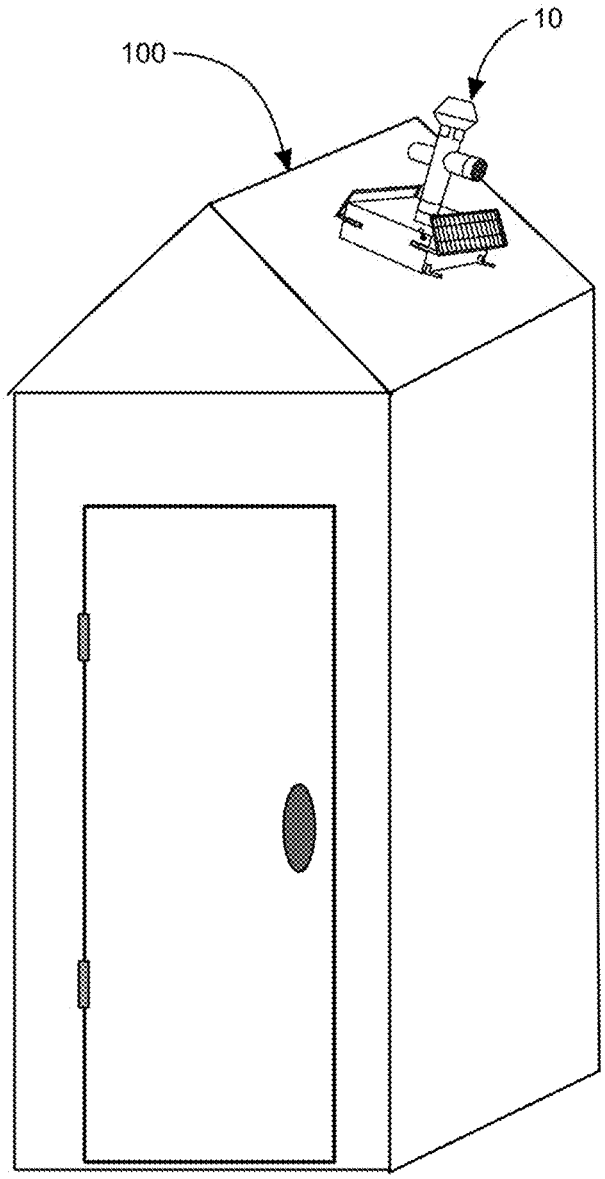
FIG. 6 is a perspective view illustrating the solar powered ventilator fan installed upon a portable toilet.

Referring now to the drawings FIGS. 1-6, the solar powered ventilator fan (10) for portable toilets (100) includes an intake member (20) and cooling fan assembly (30) that is specially designed for use with portable toilets. In this manner, the product may offer a convenient means of ventilating these facilities without the need for electricity. The device may basically be cylindrical to rectangular in shape, measuring approximately sixteen inches (16") in height and twelve and one half inches (12½") in width. With a framework (35) containing a weatherproof seal (36), and a plenum box (38) attached thereto, the fixture is configured to be installed onto the roof of the portable toilet (100) via a series of durable clamps or brackets (37). The intake member (20) can be formed as having a T-Shape including exit holes (25) and a vent cap (42). A duct hose assembly (40) is provided and connected at the base of said plenum box (38) and may include a flexible duct hose and vent hood (51) adapted to be placed within an interior of the portable toilet. The bottom of the plenum box (38) can include a swivel joint (45). The fan assembly (30) is housed inside the plenum box (38) and contains a 12 V motor with blades (34) measuring 2⅜"×2⅜" (or 3⅛"×3⅛"). Solar panels (50) are adapted to flank each side of the plenum box (38). Rectangular in shape and measuring 14" in length, 1/16" in height, and five inches (5") in width, these panels may be affixed by swivel joints (60) so that they can pivot to a desired angle.

Created to harness energy from the light of the sun, the solar panels of the Solar Light may be configured by using fiber optic light pipes connected to a parabolic collector. In addition, components may consist of a plastic case housing with the solar cell on top, a single AA Nicad battery, a small controller board, and a photo resistor to detect darkness. Like standard solar powered fixtures, the solar powered ventilator fan for portable toilets may use standard solar cells in a very straightforward application. A single solar cell produces a maximum of 0.45 volts and a varying amount of current depending on the size of the cell and the amount of light striking the surface. In a unit such as this product, therefore, one may need four cells wired in series. The four cells may produce 1.8 volts and a maximum of about 100 milliamps in full, bright sunlight.

The solar cells are wired directly to the battery through a diode (which prevents the battery's current from flowing back through the solar cell at night). A battery such as the Nicad produces about 1.2 volts and can store a maximum of approximately 700 milliamp-hours. During the day, the battery charges, reaching maximum charge except on shorter winter days or days when there is heavy overcast. At night, the solar cells stop producing power, yet the unit may be fully charged and continue to work. The solar powered ventilator fan for portable toilets may be capped with a handy protective vent cap (42) to complete the assembly.

The device may provide consumers with an automatic cooling and ventilation fan for constricted spaces found inside portable toilets, Combining the refreshing relief of air circulation with the convenience of solar power, the solar powered ventilator fan for portable toilets may foster peace of mind in users of these facilities while allowing them to use the restroom with expedience and ease. Drawing its power directly from sunlight, the solar powered ventilator fan for portable toilets may continually operate, offering a dependable alternative to standard electricity, which is not available in portable toilets. As such, the Solar powered ventilator fan for portable toilets may facilitate entering the toilet with barely a hesitant pause, without worry of coming into contact with excessive heat or left-behind waste odors. While this product was primarily conceived with portable toilets in mind, the units may be made portable themselves, easily accommodating other small, constricted spaces such as work sheds, and even vehicles that lack air conditioning. Made of durable, high quality materials and components, the Solar Powered Ventilator Fan for Portable Toilets should withstand years of continued use.

An innovative product invention, the solar powered ventilator fan for portable toilets may offer construction workers and festival goers the ultimate combination of convenience and comfort for portable toilets. Featuring a sophisticated fan system, this practical product may eliminate the frustration often associated with the heat and odors inside these units.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A solar powered ventilation fan comprising:

a cooling fan assembly including a framework adapted to be removably attached to a roof of a portable toilet via bracket members, and including a weatherproof seal attached to a bottom surface thereof and adapted to be pressed between said bottom surface and said roof;

a plenum box connected to said framework and having an interior, an exterior, a top portion having an entry hole therein, and a bottom portion having an exit hole therein;

a plurality of bracket members connected to said exterior of said plenum box and are adapted to releasably connect with said roof of said portable toilet;

an electric motor located within said interior of said plenum box and connected thereto;

a fan member located within said interior of said plenum box and mechanically connected to said electric motor, and including a plurality of blade members; and wherein said fan member is adapted to draw air from said air intake member and force it through said plenum box;

at least one solar panel connected to said framework and electrically connected to said electric motor, and adapted to collect energy from the sun and use it to provide electricity to said electric motor;

an air intake member connected to said top portion of said plenum box and around said entry hole, and including tubing adapted to allow air to pass therethrough and into said plenum box; and a duct hose assembly attached to a bottom portion of said plenum box and around said exit hole and is adapted to allow air to pass from said plenum box, therethrough, and into said portable toilet;

wherein said cooling fan assembly is adapted to be removably connected to said roof of said portable toilet and above an entry hole thereof, and draw fresh air from outside said portable toilet and send it therein; and wherein said fan member is adapted to draw air from said air intake member and force it through said plenum box, through said duct hose assembly, and into an interior volume of said portable toilet.

2. The solar powered ventilation fan of claim 1, wherein said air intake member further comprises a vent cap at a distal end of said tubing.

3. The solar powered ventilation fan of claim 1, wherein said air intake member tubing is T-shaped and has at least three air intake holes for air to enter therethrough.

4. The solar powered ventilation fan of claim 1, further wherein said duct hose assembly further comprises a vent hood on a distal end thereof and adapted to be placed within an interior of said portable toilet.

5. The solar powered ventilation fan of claim 1, wherein said at least one solar panel is connected to said framework via swivel joints, and adapted such that said at least one solar panel can be positioned at a desired angle towards the sun.

6. The solar powered ventilation fan of claim 5, wherein said at least one solar panel comprises two solar panels connected on opposite sides of said exterior of said plenum box.

7. The solar powered ventilation fan of claim 1, wherein said framework, said plenum box, said plurality of bracket members, and said exhaust member is formed from a galvanized metal material.

8. The solar powered ventilation fan of claim 1, wherein said plurality of bracket members are adjustable to thereby adapt and allow said solar powered ventilation fan to be installed upon a top surface of said portable toilet at various angles.

9. A combination of a portable toilet and a solar powered ventilation fan, said combination comprising:

a portable toilet including at least one vertical wall;

a floor member; and a roof member having an entry hole therein, wherein said at least one vertical wall, said floor member, and said roof member form an interior space of said portable toilet; and a cooling fan assembly including a framework adapted to be removably attached to said roof of said portable toilet via bracket members, and including a weatherproof seal attached to a bottom surface thereof and adapted to be pressed between said bottom surface and said roof;

a plenum box connected to said framework and having an interior, an exterior, a top portion having an entry hole therein, and a bottom portion having an exit hole therein;

a plurality of bracket members connected to said exterior of said plenum box and are adapted to releasably connect with said roof of said portable toilet;

an electric motor located within said interior of said plenum box and connected thereto;

a fan member located within said interior of said plenum box and mechanically connected to said electric motor, and including a plurality of blade members; and wherein said fan member is adapted to draw air from said air intake member and force it through said plenum box;

at least one solar panel connected to said framework and electrically connected to said electric motor, and adapted to collect energy from the sun and use it to provide electricity to said electric motor;

an air intake member connected to said top portion of said plenum box and around said entry hole, and including tubing adapted to allow air to pass therethrough and into said plenum box; and a duct hose assembly attached to a bottom portion of said plenum box and around said exit hole and is adapted to allow air to pass from said plenum box, therethrough, and into said portable toilet;

wherein said cooling fan assembly is adapted to be removably connected to said roof of said portable toilet and above an entry hole thereof, and draw fresh air from outside said portable toilet and send it therein; and wherein said fan member is adapted to draw air from said air intake member and force it through said plenum box, through said duct hose assembly, and into an interior volume of said portable toilet.

10. The solar powered ventilation fan of claim 9, wherein said air intake member further comprises a vent cap at a distal end of said tubing.

11. The solar powered ventilation fan of claim 9, wherein said air intake member tubing is T-shaped and has at least three air intake holes for air to enter therethrough.

12. The solar powered ventilation fan of claim 9, further wherein said duct hose assembly further comprises a vent hood on a distal end thereof and adapted to be placed within an interior of said portable toilet.

13. The solar powered ventilation fan of claim 9, wherein said at least one solar panel is connected to said framework via swivel joints, and adapted such that said at least one solar panel can be positioned at a desired angle towards the sun.

14. The solar powered ventilation fan of claim 13, wherein said at least one solar panel comprises two solar panels connected on opposite sides of said exterior of said plenum box.

15. The solar powered ventilation fan of claim 9, wherein said framework, said plenum box, said plurality of bracket members, and said exhaust member is formed from a galvanized metal material.

16. The solar powered ventilation fan of claim 9, wherein said plurality of bracket members are adjustable to thereby adapt and allow said solar powered ventilation fan to be installed upon a top surface of said portable toilet at various angles.

* * * * *